US009073330B2

(12) United States Patent
Iwata

(10) Patent No.: US 9,073,330 B2
(45) Date of Patent: Jul. 7, 2015

(54) PRINTER AND LIQUID TRANSFER METHOD

(71) Applicant: SEIKO EPSON CORPORATION, Tokyo (JP)

(72) Inventor: Yuji Iwata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/671,874

(22) Filed: Nov. 8, 2012

(65) Prior Publication Data

US 2013/0155132 A1 Jun. 20, 2013

(30) Foreign Application Priority Data

Dec. 20, 2011 (JP) ..... 2011-278642

(51) Int. Cl.

| | |
|---|---|
| ***B41J 29/38*** | (2006.01) |
| ***B41J 2/195*** | (2006.01) |
| ***B41J 2/17*** | (2006.01) |
| ***B41J 2/175*** | (2006.01) |

(52) U.S. Cl.
CPC ..... *B41J 2/175* (2013.01)

(58) Field of Classification Search
CPC .... B41J 2/17513; B41J 2/175; B41J 2/17596; B41J 29/38; B41J 2/17556
USPC ..... 347/6, 7, 84, 85, 86
See application file for complete search history.

(56) References Cited

U.S. PATENT DOCUMENTS

| | | | | |
|---|---|---|---|---|
| 4,607,261 | A | 8/1986 | McCann et al. | |
| 4,680,696 | A | 7/1987 | Ebinuma et al. | |
| 6,000,792 | A | 12/1999 | Koizumi et al. | |
| 6,039,442 | A | 3/2000 | Hagiwara et al. | |
| 2007/0291086 | A1* | 12/2007 | Murakami et al. | 347/85 |
| 2009/0009541 | A1 | 1/2009 | Shimazaki | |
| 2009/0135927 | A1 | 5/2009 | Prakash | |
| 2009/0167826 | A1* | 7/2009 | Ishizawa et al. | 347/86 |
| 2009/0201347 | A1 | 8/2009 | Hamano | |

(Continued)

FOREIGN PATENT DOCUMENTS

| | | |
|---|---|---|
| EP | 2305475 | 4/2011 |
| GB | 2447919 | 10/2008 |

(Continued)

OTHER PUBLICATIONS

European Search Report dated Feb. 28, 2013 for European Patent Application No. 12197728.4.

(Continued)

*Primary Examiner* — Jannelle M Lebron
(74) *Attorney, Agent, or Firm* — Workman Nydegger

(57) ABSTRACT

A printer includes an ink storage unit that stores an ink; a head unit that ejects the ink onto a medium; a plurality of supply flow channels for supplying the ink from the ink storage unit to the head unit; a plurality of bypass flow channels hung between the supply flow channels which are respectively different; a maintenance solution storage unit that stores a maintenance solution; and a controller that causes the ink to circulate inside a circulation flow channel which is configured only by the supply flow channel and the bypass flow channel among the ink storage unit, the head unit, the supply flow channel and the bypass flow channel, and that causes the maintenance solution to flow from the maintenance solution storage unit into a section located further to the downstream side of the supply flow channel than the circulation flow channel, and into the head unit.

6 Claims, 7 Drawing Sheets

(56) References Cited

U.S. PATENT DOCUMENTS

| | | | | |
|---|---|---|---|---|
| 2009/0231368 | A1 | 9/2009 | Nakano et al. | |
| 2009/0303283 | A1 | 12/2009 | Nakano et al. | |
| 2009/0315927 | A1 | 12/2009 | Uehara | |
| 2010/0007951 | A1 | 1/2010 | Bramstedt et al. | |
| 2010/0079511 | A1 | 4/2010 | Murakami et al. | |
| 2010/0085396 | A1 | 4/2010 | Yokota et al. | |
| 2010/0283808 | A1 | 11/2010 | Terakado et al. | |
| 2011/0115844 | A1* | 5/2011 | Ozawa | 347/28 |
| 2011/0267406 | A1 | 11/2011 | Hanson | |

FOREIGN PATENT DOCUMENTS

| | | |
|---|---|---|
| JP | 60-137655 | 7/1985 |
| JP | 3106013 | 11/2000 |
| JP | 2011-110853 | 6/2011 |

OTHER PUBLICATIONS

Extended European Search Report dated Dec. 7, 2012 for European Patent Application No. 12184819.6.

* cited by examiner

PRINTER AND LIQUID TRANSFER METHOD

CROSS-REFERENCE TO RELATED APPLICATIONS

This application claims the benefit of Japanese Patent Application No. 2011-278642, filed on Dec. 20, 2011, which is hereby incorporated by reference herein in its entirety.

BACKGROUND

1. Technical Field

The present invention relates to a printer and a liquid transfer method.

2. Related Art

A printer that includes an ink storage unit which stores an ink, a head unit which ejects the ink onto a medium, and a plurality of supply flow channels for supplying the ink from the ink storage unit to the head unit is well known.

JP-A-60-137655 is an example of related art.

Meanwhile, a phenomenon has often occurred where an ink stays inside the above-described supply flow channel and head unit. Thus, the related phenomenon results in a problem such as precipitation of the ink component or occurrence of clogging.

SUMMARY

An advantage of some aspects of the invention is to efficiently prevent the problem due to the stagnation of ink.

According to an aspect of the invention, there is provided a printer that includes an ink storage unit that stores an ink; a head unit that ejects the ink onto a medium; a plurality of supply flow channels for supplying the ink from the ink storage unit to the head unit; a plurality of bypass flow channels hung between the supply flow channels which are different from one another; a maintenance solution storage unit that stores a maintenance solution; and a controller that circulates the ink inside a circulation channel which is configured only by the supply flow channel and the bypass flow channel among the ink storage unit, the head unit, the supply flow channel and the bypass flow channel, and that causes the maintenance solution to flow from the maintenance solution storage unit into a section which is located further to the downstream side of the supply flow channel than the circulation flow channel, and into the head unit.

Another aspect of the invention will be disclosed with reference to the description and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
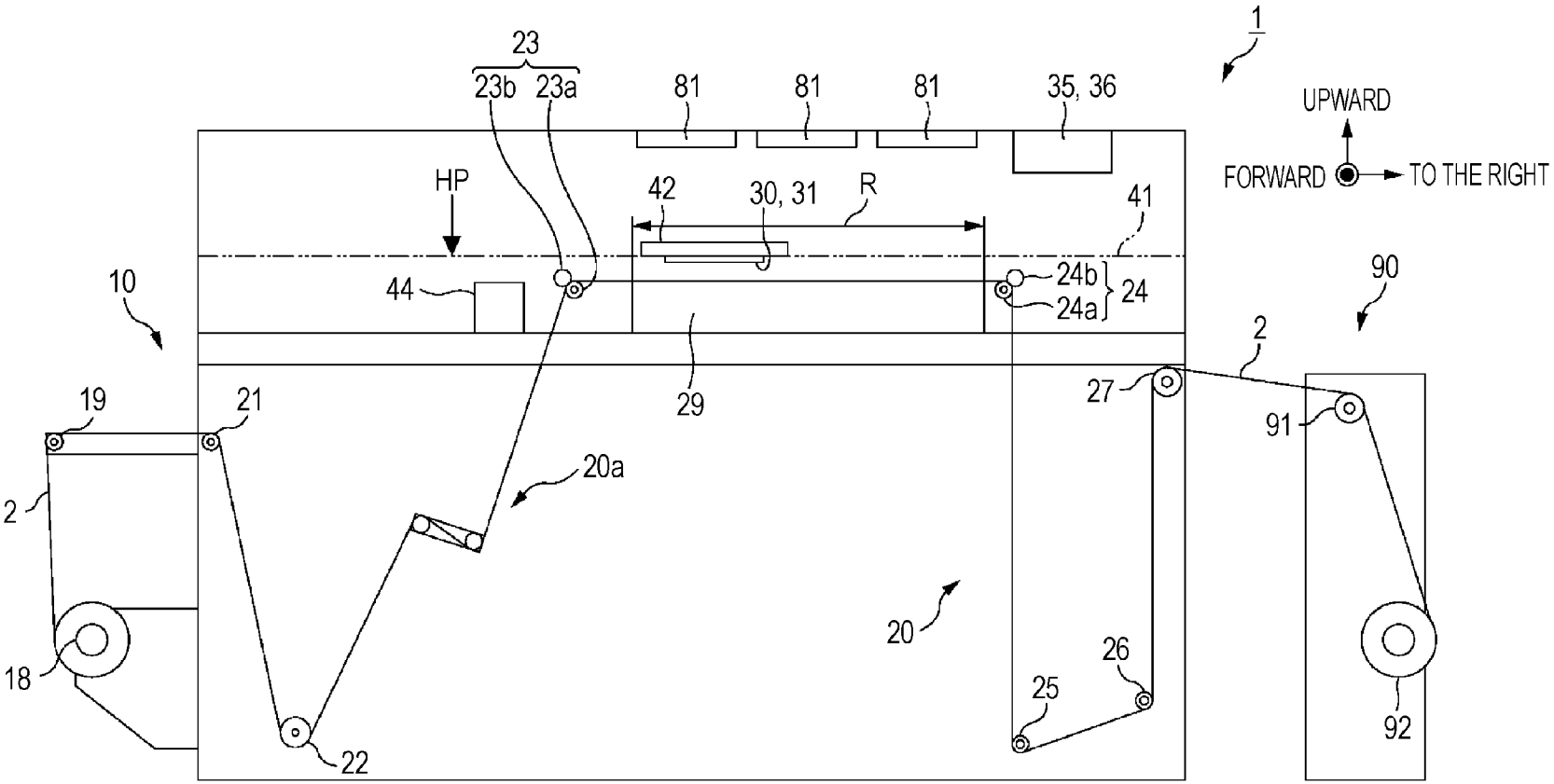
FIG. 1 is a schematic diagram illustrating a configuration of an image recorder.

At least the following aspects will be disclosed with reference to the description and the accompanying drawings.

There is provided a printer that includes an ink storage unit that stores an ink; a head unit that ejects the ink onto a medium; a plurality of supply flow channels for supplying the ink from the ink storage unit to the head unit; a plurality of bypass flow channels hung between the supply flow channels which are respectively different; a maintenance solution storage unit that stores a maintenance solution; and a controller that circulates the ink inside a circulation flow channel which is configured only by the supply flow channel and the bypass flow channel among the ink storage unit, the head unit, the supply flow channel and the bypass flow channel, and that causes the maintenance solution to flow from the maintenance solution storage unit into a section of further to the downstream side of the supply flow channel than the circulation flow channel, and into the head unit.

According to this printer, it is possible to efficiently prevent a problem due to the stagnation of ink.

In addition, the ink may be a first ink, the head unit may eject multiple types of ink including the first ink onto the medium, and the controller may undertake a printing job, perform a first ink printing process where the printing job is executed to perform printing by causing the first ink among the multiple types of ink to be ejected to the head unit, and, after the first ink printing process is completed, may cause the maintenance solution to flow in when a prescribed time elapses without the next first ink printing process being performed.

In this case, it is possible to more efficiently prevent the problem due to the stagnation of ink.

In addition, the ink may be a first ink, the head unit may eject multiple types of ink including the first ink onto the medium, the controller may undertake a printing job and may perform a first ink printing process where the printing job is performed for printing, by causing the first ink among the multiple types of ink to be ejected to the head unit, and may undertake the printing job and may perform a non-first ink printing process where the printing job is performed for printing, by causing an ink other than the first ink among the multiple types of ink to be ejected to the head unit. Based on the printing job, the controller may determine whether a printing process which is next to the first ink printing process is the first ink printing process or the non-first ink printing process, and in a case where the determination result shows the non-first ink printing process, may cause the maintenance solution to flow in when the first ink printing process is completed.

In this case, it is possible to more efficiently prevent the problem due to the stagnation of ink.

In addition, as the ink storage unit, a first ink storage unit that stores a first ink may be provided, and the head unit may eject the first ink onto the medium. As a plurality of the supply flow channels, a plurality of first ink supply flow channels may be provided in order to supply the first ink from the first ink storage unit to the head unit. As a plurality of the bypass flow channels, a plurality of first ink bypass flow channels hung between the first ink supply flow channels which are respectively different may be provided. The controller may circulate the first ink inside the circulation flow channel which is configured only by the first ink supply flow channel and the first ink bypass flow channel among the first ink storage unit, the head unit, the first ink supply flow channel and the first ink bypass flow channel, and may cause the maintenance solution to flow into the section which is located further to the downstream side of the first ink supply flow channel than the circulation flow channel, and into the head unit from the maintenance solution storage unit. A second ink storage unit that stores a second ink may be provided, and the head unit may eject the second ink onto the medium. A plurality of second ink supply flow channels may be provided in order to supply the second ink from the second ink storage unit to the head unit. And then the controller may perform a sucking process that sucks the maintenance solution and the second ink from the head unit at the same time, or may perform a flushing process that discharges the maintenance solution and the second ink from the head unit at the same time.

In this case, it is possible to save the first ink.

Next, there is provided a liquid transfer method that circulates an ink inside a circulation flow channel which is configured only by a supply flow channel and a bypass flow channel among an ink storage unit that stores the ink, a head unit that ejects the ink onto a medium, a plurality of the supply flow channels for supplying the ink from the ink storage unit to the head unit, and a plurality of the bypass flow channels hung between the supply flow channels which are respectively different; and causes a maintenance solution to flow into a section which is located further to the downstream side than the circulation flow channel, and into the head unit.

According to this liquid transfer method, it is possible to efficiently prevent the problem due to the stagnation of ink.

There is provided a liquid transfer method that circulates a first ink inside a circulation flow channel which is configured only by a first ink supply flow channel and a first ink bypass flow channel among a first ink storage unit that stores the first ink, a head unit that ejects multiple types of ink including the first ink onto a medium, a plurality of the first ink supply flow channels for supplying the first ink from the first ink storage unit to the head unit, and a plurality of the first ink bypass flow channels hung between the first ink supply flow channels which are respectively different; performs a first ink printing process where a printing job is performed for printing, by undertaking the printing job and causing the first ink among the multiple types of ink to be ejected to the head unit; and causes a maintenance solution to flow into a section which is located further to the downstream side of the first ink supply flow channel than the circulation flow channel, and into the head unit, in a case where the next first ink printing process is determined not to be performed for a prescribed period of time after the first ink printing process is completed.

In this case, it is possible to more efficiently prevent the problem due to the stagnation of ink.

Configuration Example of Image Recorder 1

Figure 2:
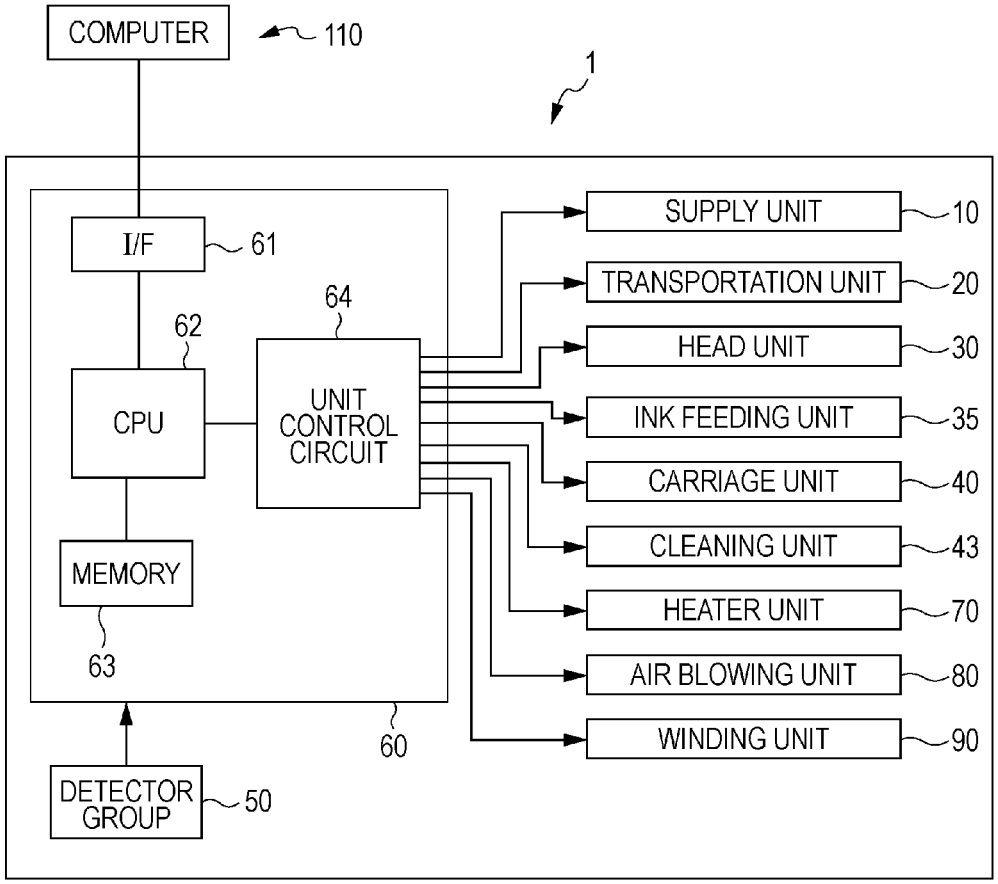
FIG. 2 is a block diagram illustrating a configuration of an image recorder.

A configuration example of an image recorder 1 (ink jet type printer in the present embodiment), as an example of the printer, will be described using FIGS. 1 and 2. FIG. 1 is a schematic cross-sectional view of the image recorder 1. FIG. 2 is a block diagram of the image recorder 1.

Further, in the following description, when referring to a "vertical direction" and a "lateral direction", the direction indicated by the arrow in FIG. 1 becomes a point of reference. In addition, when referring to a "longitudinal direction", the direction perpendicular to the paper surface in FIG. 1 is indicated.

In addition, in the present embodiment, the description is made using a rolled paper (hereinafter referred to as a roll sheet (continuous sheet)) as an example of a medium on which the image recorder 1 records an image.

As illustrated in FIGS. 1 and 2, the image recorder 1 according to the present embodiment includes a transportation unit 20, a supply unit 10, a platen 29 and a winding unit 90 along a transportation route (in FIG. 1, the transportation route is represented by a positioning section of a roll sheet 2 from a scroll roller 18 to a winding drive shaft 92) through which the transportation unit 20 transports the roll sheet 2. In addition, the image recorder 1 further includes a head unit 30 which performs an image recording by ejecting multiple types of ink onto an image recording region R on the transportation route, an ink feeding unit 35, a carriage unit 40, a cleaning unit 43, a heater unit 70, an air blowing unit 80 which sends a wind to the roll sheet 2 on the platen 29, a controller 60 which controls the units or the like and manages an operation as the image recorder 1, and a detector group 50.

The supply unit 10 supplies the roll sheet 2 to the transportation unit 20. The supply unit 10 includes the scroll roller 18 to which the roll sheet 2 is rolled and rotatably supported, and a relay roller 19 for winding the roll sheet 2 drawn from the scroll roller 18 and guiding it to the transportation unit 20.

The transportation unit 20 transports the roll sheet 2 sent by the supply unit 10 along a predetermined transportation route. As illustrated in FIG. 1, the transportation unit 20 includes a relay roller 21 positioned on the right in the horizontal direction with respect to the relay roller 19, a relay roller 22 positioned diagonally downward and to the right when viewed from the relay roller 21, a first transportation roller 23 positioned diagonally upward and to the right (upstream side of the transportation direction when viewed from the platen 29) when viewed from the relay roller 22, a steering unit (steerage unit) 20*a* positioned between the relay roller 22 and the first transportation roller 23, a second transportation roller 24 positioned on the right (downstream side in the transportation direction when viewed from the platen 29) when viewed from the first transportation roller 23, an inversion roller 25 positioned vertically downward when viewed from the second transportation roller 24, a relay roller 26 positioned on the right when viewed from the inversion roller 25 and a delivery roller 27 positioned upward when viewed from the relay roller 26.

The relay roller 21 is a roller which winds, from the left side and slackening downward, the roll sheet 2 supplied from the relay roller 19.

The relay roller 22 is a roller which winds, from the left side and transporting diagonally upward to the right, the roll sheet 2 supplied from the relay roller 21.

The first transportation roller 23 includes a first drive roller 23*a* which is driven by a motor (not illustrated) and a first driven roller 23*b* which is placed opposing the first drive roller 23*a* while pinching the roll sheet 2. The first transportation roller 23 pulls up the roll sheet 2 which is slackened downward and transports the sheet to the printing region R which opposes the platen 29. The first transportation roller 23 is set to temporarily stop the transportation while image printing is not performed with respect to the roll sheet 2 portion on the printing region R. Furthermore, the first driven roller 23*b* is rotated according to the rotation drive of the first drive roller 23*a* by the drive control of the controller 60. Thus, the transportation volume of the roll sheet 2 which is positioned on the platen 29 may be adjusted.

The transportation unit 20, as described above, includes a mechanism which transports by slackening downward the roll sheet 2 portion wound across the relay rollers 21 and 22 and the first transportation roller 23. The slackening of the roll sheet 2 is monitored by the controller 60 based on a detection signal from a slack detection sensor (not illustrated). In detail, if the loosening detection sensor detects the roll sheet 2 portion which is slackened across the relay rollers 21 and 22 and the first transportation roller 23, the transportation unit 20 can transport the roll sheet 2 in a slackening state since an appropriately large tension is applied to the portion. In contrast, if the slack detection sensor does not detect the roll sheet 2 portion which is slackened, the transportation unit 20 temporarily stops the transportation of the roll sheet 2 since an excessively large tension is applied to the portion and thus the tension may be adjusted to an appropriate magnitude.

As illustrated in FIG. 1, a steering unit 20*a* is positioned on the transportation route in a slanted state and changes a position (in the width direction (longitudinal direction illustrated in FIG. 1)), the position where the roll sheet 2 is positioned) of the roll sheet 2 in the width direction by moving rotationally. That is, when the roll sheet 2 is transported along the transportation route, there is a case where the position of the roll sheet 2 is displaced in the width direction, being caused by the variation in tension applied to the roll sheet 2 or the like due to misalignment of the relay roller, assembly error or the like. Thus, the steering unit 20*a* is provided to adjust the position of the roll sheet 2 in the width direction.

The second transportation roller 24 includes a second drive roller 24*a* which is driven by a motor (not illustrated) and a second driven roller 24*b* which is arranged opposing with respect to the second drive roller 24*a* while pinching the roll sheet 2. The second transportation roller 24 transports the roll sheet 2 portion on which the image is recorded by the head unit 30, horizontally to the right along the supporting surface of the platen 29, and then transports vertically downward. As a result, the transportation direction of the roll sheet 2 is converted. Furthermore, the second driven roller 24*b* is rotated according to the rotation drive of the second drive roller 24*a* by the drive control of the controller 60. Thus, a predetermined tension applied with respect to the roll sheet 2 portion which is positioned on the platen 29 may be adjusted.

The inversion roller 25 is a roller which winds the roll sheet 2 supplied from the second transportation roller 24 from the left upper side and transports diagonally upward and to the right.

The relay roller 26 is a roller which winds the roll sheet 2 supplied from the inversion roller 25 from the left lower side and transports upward.

The delivery roller 27 winds the roll sheet 2 supplied from the relay roller 26 from the left lower side and delivers the roll sheet 2 to a winding unit 90.

In this manner, the roll sheet 2 sequentially passes through each roller and thereby the transportation route is formed in order to transport the roll sheet 2. In addition, the roll sheet 2 is intermittently transported along the transportation route by the transportation unit 20 in region units corresponding to the printing region R.

The head unit 30 records the image on the roll sheet 2 portion which is positioned in the printing region R on the transportation route. That is, the head unit 30 forms the image by ejecting the ink onto the roll sheet 2 portion which is sent into the printing region R (on the platen 29) on the transportation route by the transportation unit 20. In the present embodiment, the head unit 30 includes 15 heads 31.

Each of the heads 31, has rows of nozzles which line up in the row direction, on the lower surface thereof. The embodiment includes the row of nozzles respectively formed from a plurality of nozzles #1 to #N per kind of ink (color) such as yellow (Y), magenta (M), cyan (C), black (K), white (W) and the like. The respective nozzles #1 to #N in the rows of nozzles are arranged linearly in the crossing direction (that is, the crossing direction is the previously described row direction) which crosses the transportation direction of the roll sheet 2. The respective rows of the nozzles are placed in parallel apart from each other along the transportation direction.

The respective nozzles #1 to #N have a piezoelectric element (not illustrated) as a drive element in order to eject ink droplets. If a voltage of a predetermined time width is applied to between electrodes provided at both of ends of the piezoelectric element, the piezoelectric element expands in response to the application time of the voltage and deforms a side wall of the flow channel of the ink. As a result, the volume of the flow channel of the ink contracts in response to the expansion of the piezoelectric element and the ink which corresponds to the contraction becomes ink droplets which are ejected from the respective nozzles #1 to #N of each color.

Then, the 15 related heads 31 line up in the above-described crossing direction (above-described row direction) and thereby the head unit 30 is formed. Accordingly, the head unit 30 has 15×N numbers of nozzles per kind of ink (color).

When the ink amount inside the head unit 30 is decreased due to the ejection of the ink by the head 31, the ink feeding unit 35 feeds the ink to the head unit 30. Furthermore, the ink feeding unit 35 will be described in detail later.

The carriage unit 40 moves the head unit 30 (head 31). The carriage unit 40 includes a carriage guide rail 41 (illustrated by two-dot chain line in FIG. 1) which extends in the transportation direction (lateral direction), a carriage 42 which is supported so as to reciprocate in the transportation direction (lateral direction) along the carriage guide rail 41, and a motor (not illustrated).

The carriage 42 includes the head unit 30, that is, includes 15 heads 31. More specifically, the carriage 42 is divided into four sub-carriages (first to fourth sub-carriages). The first to third sub-carriages respectively include four heads 31, and the fourth sub-carriage includes three heads 31.

In other words, 15 heads 31 configure four head groups, that is, configure a first head group 302 to which the first to fourth heads belong, a second head group 304 to which the fifth to eight heads belong, a third head group 306 to which the ninth to twelfth heads belong, and a fourth head group 308 to which the thirteenth to fifteenth heads belong. Then, the first head group 302 is provided in a first sub-carriage, the second head group 304 is provided in a second sub-carriage, the third head group 306 is provided in a third sub-carriage and the fourth head group 308 is provided in a fourth sub-carriage, respectively.

Then, the carriage 42 formed from four sub-carriages is configured so as to integrally move with the head unit 30 (in other words, 15 heads 31) formed from four head groups, by the drive of a motor (not illustrated), in the transportation direction (lateral direction).

A cleaning unit 43 (not illustrated in FIG. 1) cleans the heads 31. The cleaning unit 43 is provided at a home position (hereinafter referred to as HP, refer to FIG. 1) and includes a cap (not illustrated), a sucking pump 43*a* (refer to FIG. 3 and the like) and the like. If the heads 31 (carriage 42) moves in the transportation direction (lateral direction) and is positioned at HP, the cap (not illustrated) comes into contact with a lower surface (nozzle surface) of the heads 31. If the sucking pump 43*a* is operated in such a state where the cap is in contact therewith, the ink inside the heads 31 is sucked together with thickened ink or paper dust (in this case, the ink is not sucked per kind of ink (color), but all kinds (all colors) of ink are sucked at the same time). In this manner, a clogged nozzle is restored from the non-ejecting state and thereby the cleaning of the head is completed.

In addition, a flushing unit 44 is provided between HP and the platen 29 in the transportation direction (lateral direction). If the heads 31 (carriage 42) move in the transportation direction (lateral direction) and are positioned at the position opposing the flushing unit 44, the heads 31 eject the ink from each nozzle which belongs to the above-described nozzle row, and perform a flushing operation for flushing.

The platen 29 supports the roll sheet 2 (portion thereof) which is positioned in the printing region R on the transportation route, and heats the roll sheet 2 (portion thereof) (that is, the head unit 30 is supported by the platen 29 and ejects the ink onto the heated roll sheet 2). As illustrated in FIG. 1, the platen 29 is provided corresponding to the printing region R on the transportation route and arranged at a region along the transportation route between the first transportation roller 23 and the second transportation roller 24. Thus, the platen 29 can heat the portion of the roll sheet 2, by receiving the supply of heat generated by the heater unit 70.

The heater unit 70 is provided in order to heat the roll sheet 2 and includes a heater (not illustrated). The heater has nichrome wires and is configured so that the nichrome wires inside the platen 29 are arranged to have a constant distance from a supporting surface of the platen 29.

For that reason, the heater, the nichrome wires themselves generating heat due to being electrically connected, can transmit the heat to the roll sheet 2 portion which is positioned on the supporting surface of the platen 29. Since the heater is configured so that the nichrome wires are built-in all over the platen 29, the heat may be uniformly transmitted with respect to the roll sheet 2 portion on the platen 29. In the present embodiment, the roll sheet 2 portion is uniformly heated such that the temperature of the roll sheet 2 portion on the platen 29 becomes 45° C. As a result, the ink which is landed on the roll sheet 2 portion can be dried.

The air blowing unit 80 is provided in order to send the wind to the roll sheet 2 on the platen 29. The air blowing unit 80 includes fans 81 and a motor (not illustrated) which rotates the fans 81. The fans 81, send the wind to the roll sheet 2 on the platen 29 by rotating and dry the ink which is landed on the roll sheet 2. As illustrated in FIG. 1, a plurality of the fans 81 are provided in a cover (not illustrated) which is provided at the main body and capable of opening and closing. Then, when the cover is closed, each of the fans 81 is positioned upward from the platen 29 and opposes the supporting surface (roll sheet 2 on the platen 29) of the platen 29.

The winding unit 90 winds the roll sheet 2 (roll sheet which finishes image printing) supplied by the transportation unit 20. The winding unit 90 includes a relay roller 91 which transports the roll sheet 2 supplied from the delivery roller 27 from the upper left side diagonally downward and to the right and a winding drive shaft 92 which is rotatably supported and winds the roll sheet 2 supplied from the relay roller 91.

The controller 60 is a control unit for controlling the image recorder 1. As illustrated in FIG. 2, the controller 60 includes an interface unit 61, a CPU 62, a memory 63 and a unit control circuit 64. The interface unit 61 sends and receives data between a host computer 110 which is an external device and the image recorder 1. The CPU 62 is an arithmetic processing unit to control the entire image recorder 1. The memory 63 secures a region which stores programs of the CPU 62, working space or the like. The CPU 62 controls each unit using the unit control circuit 64 according to the programs stored in the memory 63.

The detector group 50 monitors situations inside the image recorder 1 and, for example, includes a rotary-type encoder which is attached to the transportation roller and used in controlling the transportation of the roll sheet 2 or the like, a sheet detecting sensor which detects whether the transported roll sheet 2 is present or absent, a linear-type encoder which detects the position of the carriage 42 (or the heads 31) in the transportation direction (lateral direction), a sheet edge position detecting sensor which detects the position of the sheet edge (edge) in the width direction of the roll sheet 2, an ink sub-tank sensor or a maintenance solution sub-tank sensor (to be described later), and the like.

Ink Feeding Unit 35

Figure 3:
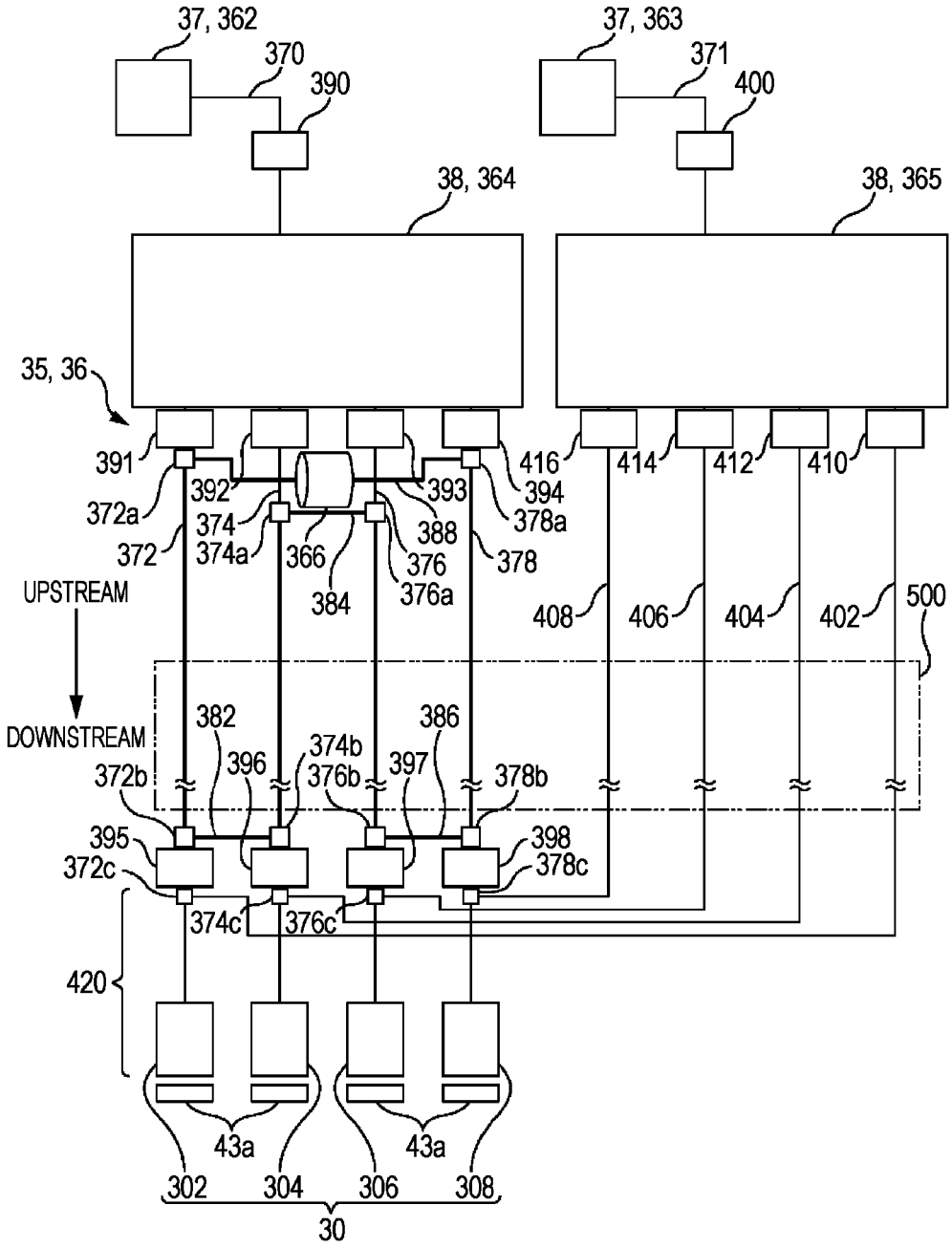
FIG. 3 is a block diagram of a white ink feeding unit.

Next, an ink feeding unit 35 will be described with reference to FIGS. 1 and 3. FIG. 3 is a block diagram of a white ink feeding unit 36.

As previously described, the ink feeding unit 35 feeds (supplies) the ink to the head unit 30 when the ink amount inside the head unit 30 decreases due to the ejecting of the ink by the heads 31.

The ink feeding unit 35 is provided for each kind of ink (ink color). That is, a yellow ink feeding unit for feeding a yellow ink, a magenta ink feeding unit for feeding a magenta ink, a cyan ink feeding unit for feeding a cyan ink, a black ink feeding unit 36 for feeding a black ink, a white ink feeding unit for feeding a white ink (corresponding to the first ink) and the like are provided.

Herein, the reason will be described later, but the white ink feeding unit 36 has a different configuration from the other kinds (colors) of ink feeding units other than the white ink (in contrast, the configurations of the other kinds (color) of ink feeding units other than the white ink are the same). Hereinafter, the white ink feeding unit 36 will be mainly described among those of a plurality of the ink feeding units 35, and with regard to the other kinds (colors) of ink feeding units, the only different point from the white ink feeding unit 36 will be described later.

As illustrated in FIG. 3, the white ink feeding unit 36 includes a cartridge 37 (an ink cartridge 362 and a maintenance solution cartridge 363), a sub-tank 38 (an ink sub-tank 364 as an example of an ink storage unit which stores the ink, and a maintenance solution sub-tank 365 as an example of a maintenance solution storage unit which stores the maintenance solution), multiple tubes which become flow channels (passage) of the ink or the maintenance solution, multiple valves (in the present embodiment, the valves are solenoid valves, but not limited thereto) which open and close the tubes, and pumps 366 (in the present embodiment, the pumps are tube pumps, but not limited thereto). Furthermore, a place where the cartridge 37 and the sub-tank 38 are arranged is indicated by reference numerals 35 and 36 in FIG. 1.

The ink cartridge 362 accommodates the ink to be supplied to the head unit 30. The ink cartridge 362 is configured to be attachable and detachable with respect to the image recorder main body.

In addition, as illustrated in FIG. 3, the ink cartridge 362 is connected to the ink sub-tank 364 via a tube (for convenience, the tube is referred to as an inter IC-IST tube 370) which links the ink cartridge 362 and the ink sub-tank 364.

The ink sub-tank 364 temporarily stores the ink supplied from the ink cartridge 362 to the head unit 30. The ink sub-tank 364 is fixed to the image recorder main body. That is, unlike the ink cartridge 362, the ink sub-tank 364 is configured so as not to be attachable and detachable with respect to the image recorder main body.

In addition, although it has been described that the ink sub-tank 364 is connected to the ink cartridge 362 via the inter IC-IST tube 370, as illustrated in FIG. 3, the inter IC-IST tube 370 includes a valve (for convenience, the valve is referred to as an inter IC-IST valve 390). Furthermore, the sub-ink tank 364 includes an ink sub-tank sensor (not illustrated) which detects if the ink amount inside the ink sub-tank 364 becomes less than the threshold value.

Then, if a controller 60 understands that the ink amount inside the ink sub-tank 364 is less than the threshold value by receiving the detection signal from the ink sub-tank sensor, opens the closed inter IC-IST valve 390, and causes the ink to flow from the ink cartridge 362 into the ink sub-tank 364. In this manner, in the ink sub-tank 364, the ink amount is controlled such that the amount of the ink which is equal to or more than the threshold value is always present (is stored).

In addition, as illustrated in FIG. 3, the ink sub-tank 364 is connected to the head unit 30 via four supply tubes which link the ink sub-tank 364 and the head unit 30. Those four supply tubes (a first supply tube 372, a second supply tube 374, a third supply tube 376 and a fourth supply tube 378) function as a supply flow channel for supplying the ink from the ink sub-tank 364 to the head unit 30.

That is, if the ink is ejected from the head unit 30 (heads 31) by performing an image recording (printing) and the like, and the ink inside the head unit 30 (heads 31) is consumed, the ink inside the ink sub-tank 364 is configured so as to flow into the head unit 30 (heads 31) through the first to fourth supply tubes 372 to 378 in order to supplement the consumed ink.

In addition, as described previously, the head unit 30 according to the present embodiment has 15 heads 31 and the 15 heads 31 include four head groups, that is, the first to fourth head groups 302 to 308. However, each of the four supply tubes is connected to each of the four head groups, as illustrated in FIG. 3. In other words, each of the four supply tubes supplies the ink to each of the corresponding head groups.

That is, the first supply tube 372 is connected to the first head group 302 (the first to fourth heads) and supplies the ink to the first to fourth heads. In addition, the second supply tube 374 is connected to the second head group 304 (the fifth to eighth heads) and supplies the ink to the fifth to eighth heads. In addition, the third supply tube 376 is connected to the third head group 306 (the ninth to twelfth heads) and supplies the ink to the ninth to twelfth heads. In addition, the fourth supply tube 378 is connected to the fourth head group 308 (the thirteenth to fifteenth heads) and supplies the ink to the thirteenth to fifteenth heads.

Furthermore, as is obvious in FIG. 3, the ink sub-tank 364 of the ink feeding unit 35 is positioned apart from the head unit 30. Accordingly, each of the first to fourth supply tubes 372 to 378 is an extremely long tube, whose length is five to six meters. Then, as illustrated in FIG. 3, a cable bearer 500 is provided in order to train the first to fourth supply tubes 372 to 378. The first to fourth supply tubes 372 to 378 are accommodated inside the cable bearer 500.

In addition, as illustrated in FIG. 3, a bypass tube as an example of the bypass flow channel is hung between the supply tubes which are different from one another. More specifically, four bypass tubes (first to fourth bypass tubes 382 to 388) are provided. The first bypass tube 382 is hung between the first supply tube 372 and the second supply tube 374, the second bypass tube 384 is hung between the second supply tube 374 and the third supply tube 376, the third bypass tube 386 is hung between the third supply tube 376 and the fourth supply tube 378, and the fourth bypass tube 388 is hung between the fourth supply tube 378 and the first supply tube 372.

Furthermore, each of the first to fourth bypass tubes 382 to 388 is an extremely short tube, whose length is 5 to 20 cm, unlike the first to fourth supply tubes 372 to 378.

In addition, as illustrated in FIG. 3, both of the second bypass tube 384 and the fourth bypass tube 388 are positioned at the closer position from the ink sub-tank 364 between the ink sub-tank 364 and the head unit 30. In contrast, both of the first bypass tube 382 and the third bypass tube 386 are positioned at the closer position from the head unit 30 between the ink sub-tank 364 and the head unit 30. In other words, the second bypass tube 384 and the fourth bypass tube 388 are provided, outside the cable bearer 500, between the cable bearer 500 and the ink sub-tank 364. The first bypass tube 382 and the third bypass tube 386 are provided, outside the cable bearer 500, between the cable bearer 500 and the head unit 30.

Then, these bypass tubes are provided such that the ink is made to circulate inside the circulation flow channel configured from the supply tube and the bypass tube, in order to prevent a problem (ink ingredient is precipitated, clogging occurs or the like) due to the stagnation of ink inside the supply tube.

That is, by providing the bypass tubes, a closed flow channel configured of the first supply tube 372, the first bypass tube 382, the second supply tube 374, the second bypass tube 384, the third supply tube 376, the third bypass tube 386, the fourth supply tube 378 and the fourth bypass tube 388 is formed (the closed flow channel is illustrated using a thick line in FIG. 3. Furthermore, the thick line is used for convenience only to illustrate which section is the closed flow channel in FIG. 3 and thereby the thickness of the line has no relation with the thickness of the tube). That is, the closed flow channel to be formed is configured only by the supply tube and the bypass tube among the ink sub-tank 364, the head unit 30, the supply tube and the bypass tube.

Then, a pump 366 for causing the ink to flow in the closed flow channel is provided at the tube (in the present embodiment, the tube is the fourth bypass tube 388, but not limited thereto). If the pump 366 is operated, the closed flow channel becomes the circulation flow channel and consequently the ink is circulated inside the circulation flow channel.

In this manner, it is possible to prevent the problem due to the stagnation of ink inside the supply tube by circulating the ink inside the circulation flow channel. However, the ink cannot be circulated in a section (although the section is a small section among the entire supply tubes) positioned at the further downstream side than the circulation flow channel. In addition, in the head unit 30 positioned at the further downstream side than the above section, the same phenomenon occurs.

Accordingly, in the image recorder 1, the other measure is adopted in order to prevent the above-described problem due to the stagnation of ink at the places (section positioned at the further downstream side than the circulation flow channel, and the head unit 30. Hereinafter, for convenience, referred to as a downstream side place 420).

That is, the controller 60 according to the present embodiment is configured to remove the ink from the downstream side place 420 in order not to increase the problem due to the stagnation of ink, when an image forming process (that is, a white ink printing process) is not performed by ejecting the white ink, and configured to alternatively replenish the maintenance solution for the downstream side place 420. Therefore, in order to realize this, the image recorder 1 includes a supply system which supplies the maintenance solution to the downstream side place 420, and the controller 60 allows the maintenance solution to flow in the downstream side place 420.

Furthermore, the maintenance solution, as the name shows, is prepared to maintain and repair the section (even in a case of long time staying) of the supply tube or the head unit 30, through which the ink passes, without any precipitation or clogging. More specifically, the composition or the physical feature is close to the ink, but the maintenance solution has only the solvent component without containing solids such as a pigment (as an example, the one where the pigment is removed from the ink). Accordingly the cost is cheaper than the ink.

Hereinafter, a configuration of the ink feeding unit 35, particularly a configuration of the supply system of the maintenance solution will be subsequently described.

The maintenance solution cartridge 363 accommodates the maintenance solution which is to be supplied to the downstream side place 420. The maintenance solution cartridge 363 is configured to be attachable and detachable with respect to the image recorder main body.

In addition, as illustrated in FIG. 3, the maintenance solution cartridge 363 is connected to the maintenance solution sub-tank 365 via a tube (for convenience, the tube is referred to as an inter MC-MST tube 371) which links the maintenance solution cartridge 363 and the maintenance solution sub-tank 365.

The maintenance solution sub-tank 365 temporarily accommodates the maintenance solution which is supplied from the maintenance solution cartridge 363 to the downstream side place 420. The maintenance solution sub-tank 365 is fixed to the image recorder main body. That is, unlike the maintenance solution cartridge 363, the maintenance solution sub-tank 365 is configured to not be attachable and detachable with respect to the image recorder main body.

In addition, it has been already described that the maintenance solution sub-tank 365 is connected to the maintenance solution cartridge 363 via the inter MC-MST tube 371. As illustrated in FIG. 3, the inter MC-MST tube 371 includes a valve (for convenience, the valve is referred to as an inter MC-MST valve 400). Furthermore, the maintenance solution sub-tank 365 includes a maintenance solution sub-tank sensor (not illustrated) which detects whether the amount of the maintenance solution inside the maintenance solution sub-tank 365 is less than the threshold value.

Then, if the controller 60 understands that the amount of the maintenance solution inside the maintenance solution sub-tank 365 is less than the threshold value by receiving the detection signal from the maintenance solution sub-tank sensor, opens the closed inter MC-MST valve 400, and causes the maintenance solution to flow from the maintenance solution cartridge 363 into the maintenance solution sub-tank 365. In this manner, in the maintenance solution sub-tank 365, the amount of the maintenance solution is controlled such that the maintenance solution having amount which is equal to or more than the threshold value is always present (is stored).

In addition, as illustrated in FIG. 3, the maintenance solution sub-tank 365 is connected to the downstream side place 420 via four supply tubes which link the maintenance solution sub-tank 365 and the downstream side place 420 (more specifically, connected to the further downstream side than a head unit side valve (to be described later), in the vicinity of the head unit side valve). The four supply tubes (a fifth supply tube 402, a sixth supply tube 404, a seventh supply tube 406 and an eight supply tube 408) function as the supply flow channel for supplying the maintenance solution from the maintenance solution sub-tank 365 to the downstream side place 420. That is, the maintenance solution inside the maintenance solution sub-tank 365 is made to flow into the downstream side place 420 through the fifth to eight supply tubes 402 to 408.

In addition, each of the fifth to eighth supply tubes 402 to 408 is respectively connected to each of the first to fourth supply tubes 372 to 378 as illustrated in FIG. 3.

That is, the fifth supply tube 402 is connected to the first supply tube 372, and supplies the maintenance solution to a section of the first supply tube 372 positioned at the further downstream side than the circulation flow channel, and to the first head group 302 (the first to fourth heads). In addition, the sixth supply tube 404 is connected to the second supply tube 374, and supplies the maintenance solution to a section of the second supply tube 374 positioned at the further downstream side than the circulation flow channel, and to the second head group 304 (the fifth to eighth heads). In addition, the seventh supply tube 406 is connected to the third supply tube 376, and supplies the maintenance solution to a section of the second supply tube 376 positioned at the further downstream side than the circulation flow channel, and to the third head group 306 (the ninth to twelfth heads). In addition, the eighth supply tube 408 is connected to the fourth supply tube 378, and supplies the maintenance solution to a section of the fourth supply tube 378 positioned at the further downstream side than the circulation flow channel, and to the fourth head group 308 (the thirteenth to fifteenth heads).

Furthermore, as is obvious in FIG. 3, the maintenance solution sub-tank 365 of the ink feeding unit 35 is positioned apart from the downstream side place 420. Accordingly, each of the fifth to eighth supply tubes 402 to 408 is an extremely long tube, whose length is five to six meters. Then, as illustrated in FIG. 3, the fifth to eighth supply tubes 402 to 408 are also accommodated inside the cable bearer 500.

In addition, as illustrated in FIG. 3, each of the first to fourth supply tubes 372 to 378 includes two valves (referred to as an ink sub-tank side valve and a head unit side valve). In addition, each of the fifth to eight supply tubes 402 to 408 includes one valve (referred to as a maintenance solution sub-tank side valve), and a total twelve valves are provided at the supply tubes.

That is, as the ink sub-tank side valve, the first supply tube 372 includes a first ink sub-tank side valve 391 between a first connection portion 372*a* to which the fourth bypass tube 388 is connected and the ink sub-tank 364. The second supply tube 374 includes a second ink sub-tank side valve 392 between a second connection portion 374*a* to which the second bypass tube 384 is connected and the ink sub-tank 364. The third supply tube 376 includes a third ink sub-tank side valve 393 between a third connection portion 376*a* to which the second bypass tube 384 is connected and the ink sub-tank 364. The fourth supply tube 378 includes a fourth ink sub-tank side valve 394 between a fourth connection portion 378*a* to which the fourth bypass tube 388 is connected and the ink sub-tank 364.

In addition, as the head unit side valve, the first supply tube 372 includes a first head unit side valve 395 between a fifth connection portion 372*b* to which the first bypass tube 382 is connected and a ninth connection portion 372*c* to which the fifth supply tube 402 is connected. The second supply tube 374 includes a second head unit side valve 396 between a sixth connection portion 374*b* to which the first bypass tube 382 is connected and a tenth connection portion 374*c* to which the sixth supply tube 404. The third supply tube 376 includes a third head unit side valve 397 between a seventh connection portion 376*b* to which the third bypass tube 386 is connected and an eleventh connection portion 376*c* to which the seventh supply tube 406 is connected. The fourth supply tube 378 includes a fourth head unit side valve 398 between an eighth connection portion 378*b* to which the third bypass tube 386 is connected and a twelfth connection portion 378*c* to which the eight supply tube 408.

In addition, as the maintenance solution sub-tank side valve, in the vicinity of the maintenance solution sub-tank 365, the fifth supply tube 402 includes a first maintenance solution sub-tank side valve 410. The sixth supply tube 404 includes a second maintenance solution sub-tank side valve 412. The seventh supply tube 406 includes a third maintenance solution sub-tank side valve 414. The eighth supply tube 408 includes a fourth maintenance solution sub-tank side valve 416.

Furthermore, the reason why the ink sub-tank side valves, the head unit side valves and the maintenance solution sub-tank side valves are provided will be described later.

Process to Prevent Problem Due to Stagnation of Ink

As described above, the present embodiment jointly adopts both of a process (for convenience, referred to as an ink circulation process) which circulates the ink inside the circulation flow channel in order to prevent the problem due to the stagnation of ink in the supply tube or the head unit 30, and a process (for convenience, referred to as a maintenance solution injection process) which causes the maintenance solution to flow into the section of the supply tube positioned at the further downstream side than the circulation flow channel, and into the head unit 30 (downstream side place 420).

Herein, first, the ink circulation process and the maintenance solution injection process will be described in detail. Then, continuously, an advantageous aspect of the present embodiment, that is, the competitiveness in jointly adopting both processes will be described.

Ink Circulation Process

Figure 4:
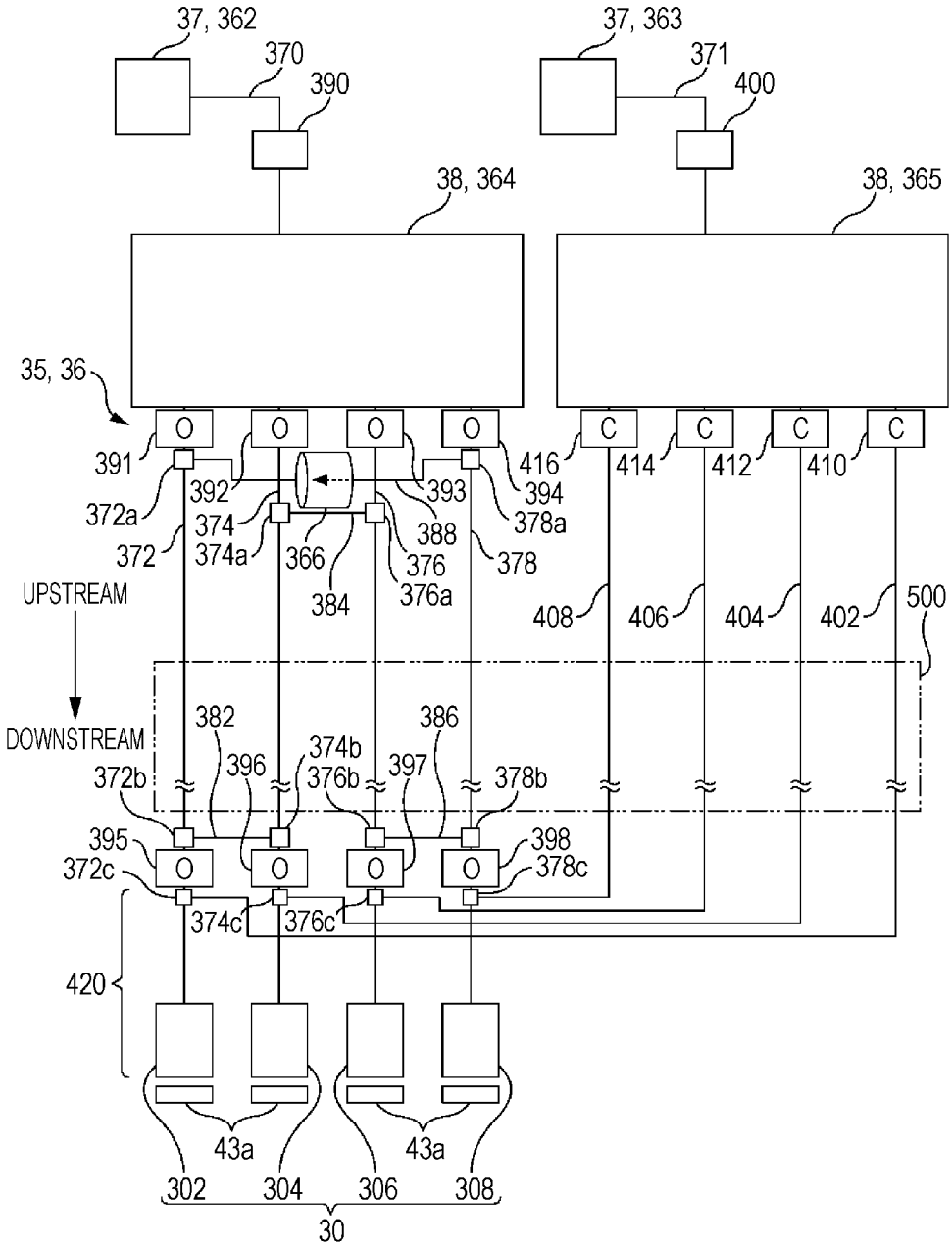
FIG. 4 is a block diagram illustrating a state of a white ink feeding unit before an ink circulation process is performed.
Figure 5:
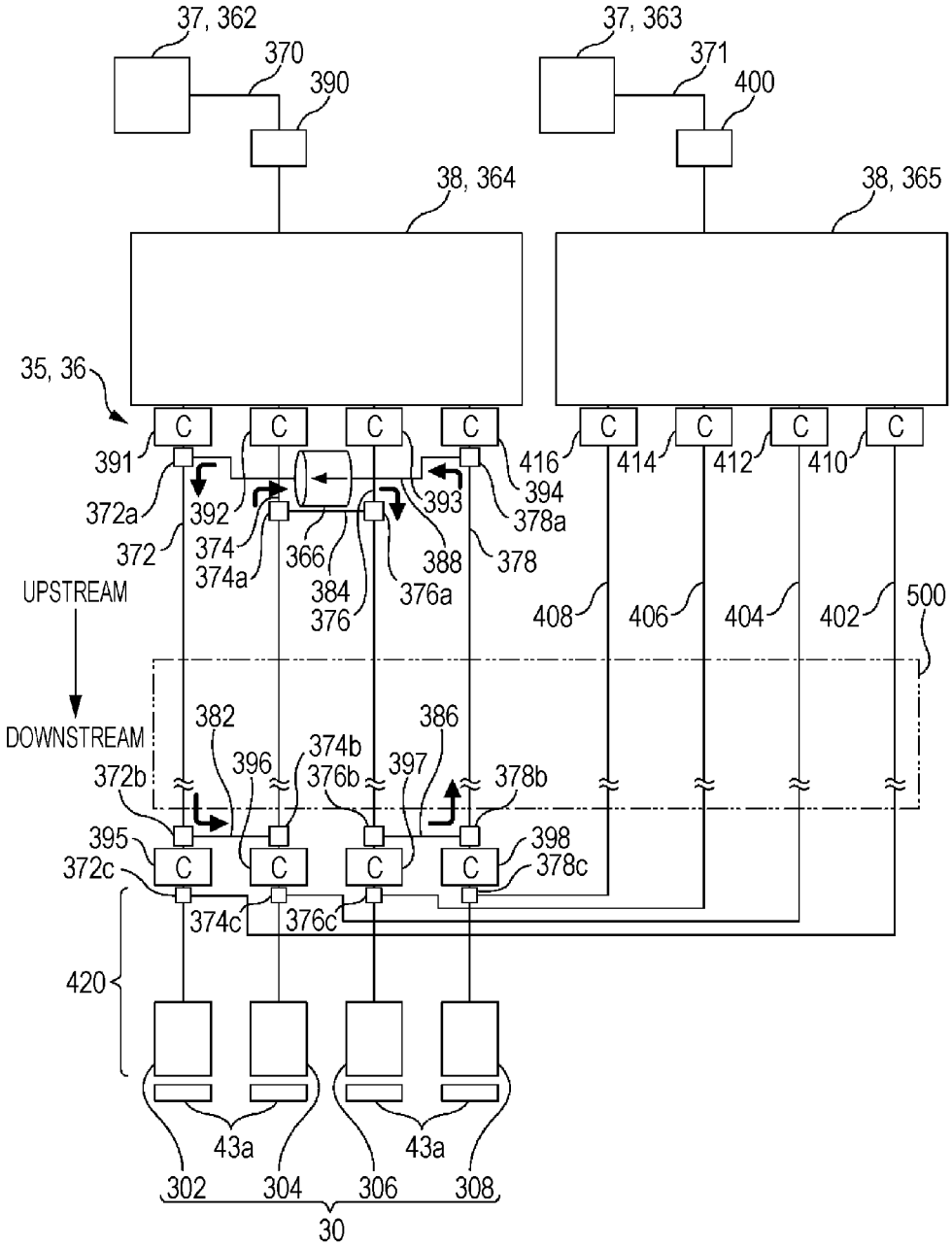
FIG. 5 is a block diagram illustrating a state of a white ink feeding unit when an ink circulation process is performed.

Here, the process (ink circulation process) which circulates the ink inside the circulation flow channel will be described using FIGS. 4 and 5. FIG. 4 is a block diagram illustrating a state of the white ink feeding unit 36 before the ink circulation process is performed. FIG. 5 is a block diagram illustrating a state of the white ink feeding unit 36 when the ink circulation process is performed.

As described above, if the ink stays inside the supply tubes (that is, the first to fourth supply tubes 372 to 378), the problem such as precipitation of the ink ingredient or clogging can occur. Then, if a related problem occurs, the ink ejecting is hindered. Even though the ink is ejected, the ink lacking in the ingredient is ejected onto the roll sheet 2 and thereby the image quality deteriorates.

Thus, the phenomenon easily occurs in a case where the image recorder 1 is unused for a long period of time. Therefore, in this case, when the power is turned on, the ink circulation process is set to be performed.

Referring to FIG. 4, the state of the white ink feeding unit 36 before the ink circulation process is performed, in other words, the state of the white ink feeding unit 36 immediately after the power is turned on, is illustrated. At this time, as illustrated in FIG. 4, the ink sub-tank side valve and the head unit side valve are open ("O" represents "valve is open") and the pump 366 is not operated (dotted line arrow represents "pump is inoperative"). Then, when the power is turned off, the image recorder 1 is unused. Accordingly, the ink stays inside the first to fourth supply tubes 372 to 378.

Then, in such a state, the ink circulation process is performed by the controller 60. That is, the controller 60 allows the ink to be circulated inside the circulation flow channel configured only by the supply tubes and the bypass tubes. Then, in the present embodiment, the controller 60 performs the following in order to realize the related process.

That is, as illustrated in FIG. 5, the controller 60 operates the pump 366 (solid line arrow represents "pump operative"). Then, consequently, the ink is circulated inside the circulation flow channel and thereby it is possible to prevent the problem due to the stagnation of ink inside the supply tube.

Furthermore, when the ink is circulated inside the circulation flow channel, in order to perform the circulation without delay and additionally in order to completely eliminate a possibility where the ink sub-tank 364 is negatively influenced by the ink movement due to the circulation, the controller 60 closes the first to fourth ink sub-tank side valves 391 to 394, as illustrated in FIG. 5 ("C" represents "valve is closed").

In addition, in the same manner, in order to perform the circulation without delay and additionally in order to completely get rid of a possibility where the head unit 30 is negatively influenced by the ink movement due to the circulation, the controller 60 closes the first to fourth head unit side valves 395 to 398, as illustrated in FIG. 5.

Furthermore, it has been already described that the ink circulation process intends to prevent the problem such as the precipitation of the ink or the occurrence of clogging. However, the related problem easily occurs in a case of the white ink, compared to the other inks. That is, since the pigment component of the white ink contains heavy materials such as titanium oxide, the pigment component has a tendency to be significantly precipitated, and further accordingly, the clogging also easily occurs.

Therefore, in the present embodiment, the ink circulation process is performed only with respect to the white ink. Accordingly, the bypass tube, the pump 366 and the head unit side valve are provided only at the white ink feeding unit 36, but are not provided at the other kinds (colors) of ink feeding units 35 (ink sub-tank side valve is necessary for the other use and thus is also provided at the other color ink feeding unit 35).

However, without being limited to the above description, it may be preferable that in order to perform the ink circulation process with respect to the other kinds (colors) of ink, the bypass tube, the pump 366 and the head unit side valve may be provided at the other kind (color) ink feeding units 35 as well.

Maintenance Solution Injection Process

Figure 6:
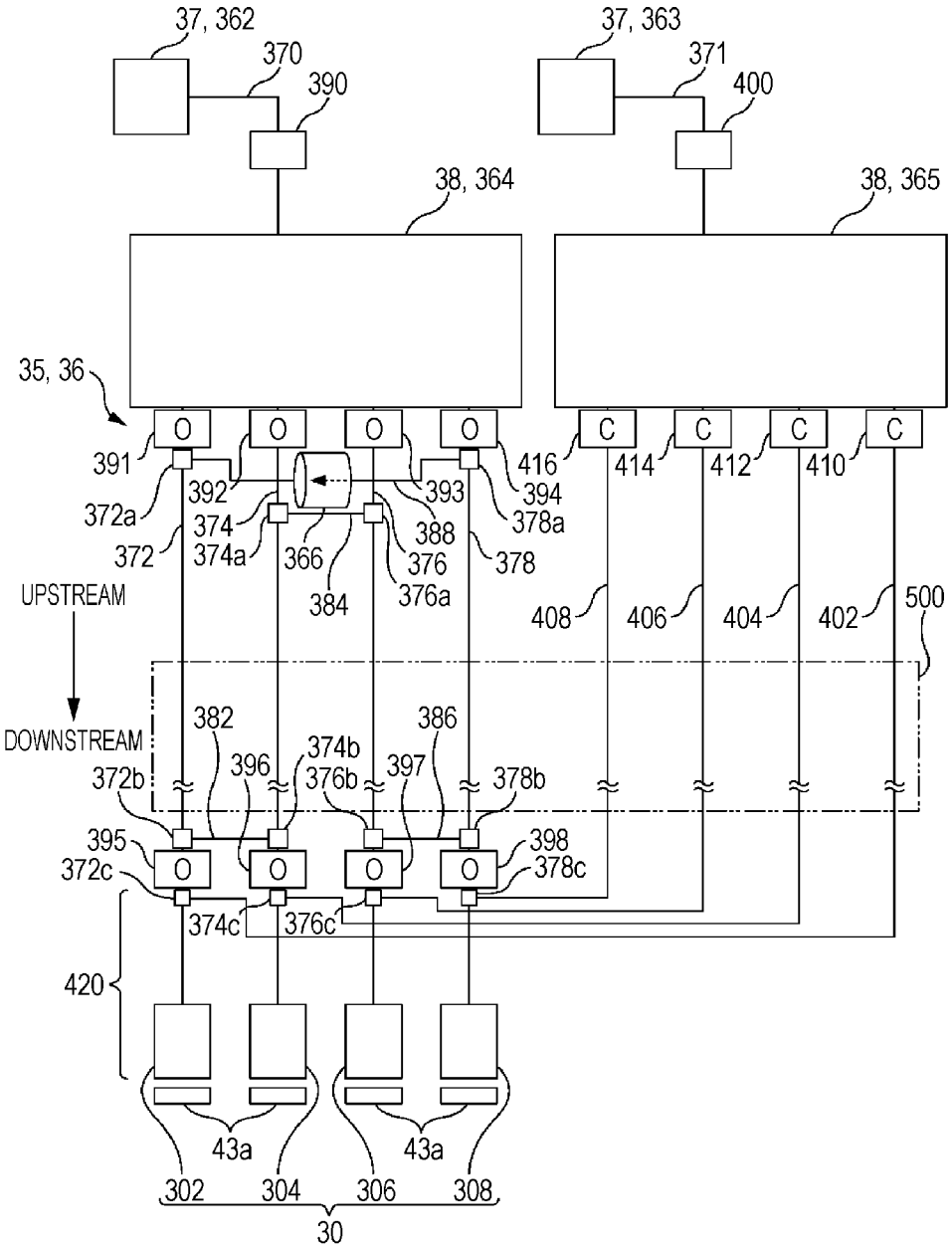
FIG. 6 is a block diagram illustrating a state of a white ink feeding unit before a maintenance solution injection process is performed.
Figure 7:
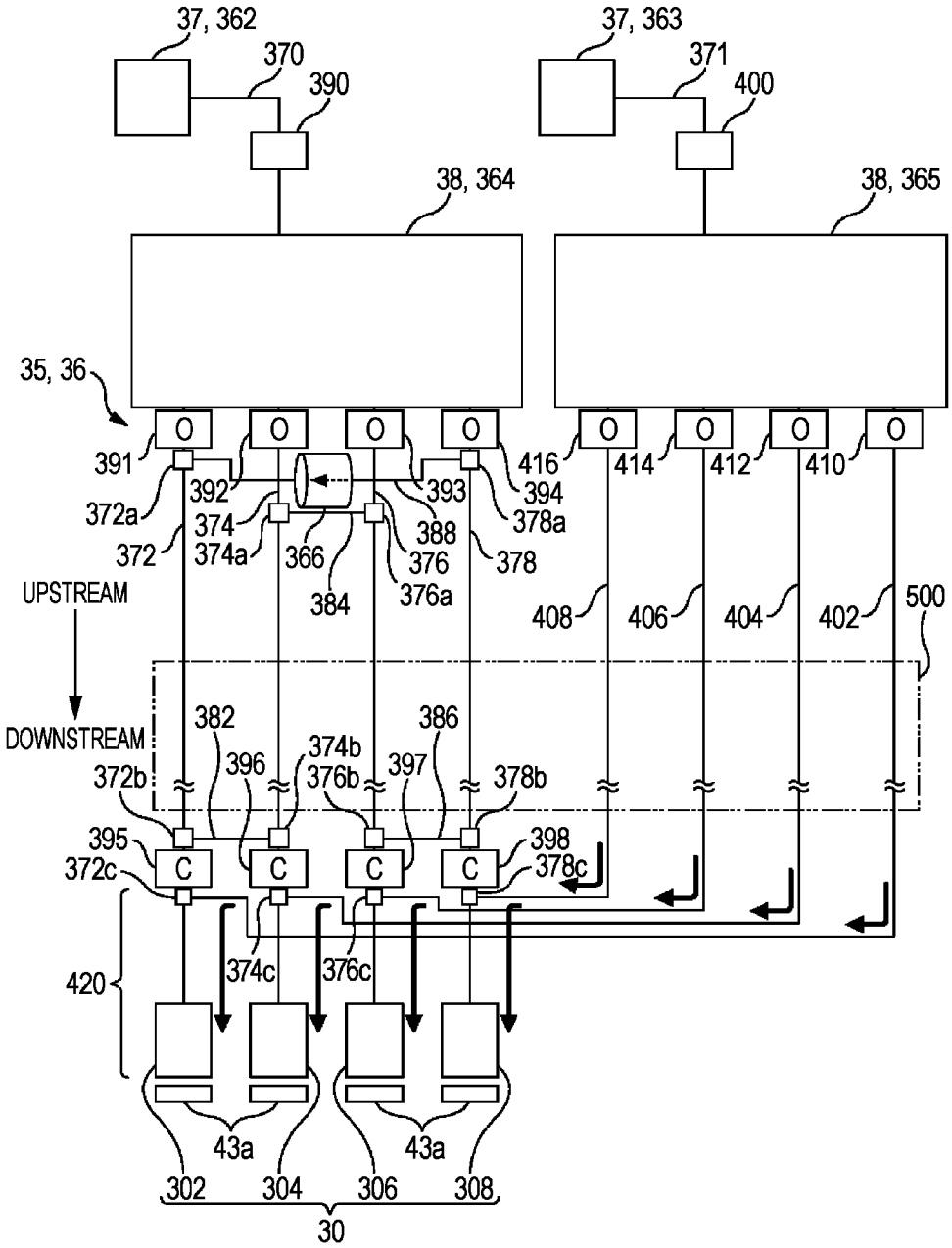
FIG. 7 is a block diagram illustrating a state of a white ink feeding unit when a maintenance solution injection process is performed.

Next, a process (maintenance solution injection process) which causes the maintenance solution to flow into the section of the supply tube positioned at the further downstream side than the circulation flow channel, and into the head unit 30 (downstream side place 420) will be described using FIGS. 6 and 7. FIG. 6 is a block diagram illustrating a state of the white ink feeding unit 36 before the maintenance solution injection process is performed. FIG. 7 is the block diagram illustrating the state of the white ink feeding unit 36 when the maintenance solution injection process is being performed.

As described above, the maintenance solution injection process is a process which removes the ink from the downstream side place 420 and alternatively causes the maintenance solution to flow into the downstream side place 420, and consequently is performed when the process (that is, white ink printing process) which forms the image by ejecting the white ink is determined not to be performed for a predetermined time. Therefore, herein, when the white ink printing process is completed, the maintenance solution injection process is performed.

As illustrated in FIG. 6, before the maintenance solution injection process is performed, the ink sub-tank side valve and the head unit side valve are open. In contrast, the maintenance solution sub-tank side valve is closed. In addition, though not illustrated in the drawing, the head unit 30 (heads 31) is positioned at HP, and a cap is in close contact with the lower surfaces (nozzle surfaces) of the heads 31.

Then, in such a state, the maintenance solution injection process is performed by the controller 60. That is, the controller 60 causes the maintenance solution to flow into the downstream side place 420 from the maintenance solution sub-tank 365. And then, in the present embodiment, the controller 60 performs the following in order to realize the related process.

That is, as illustrated in FIG. 7, the controller 60 closes the head unit side valve, opens the maintenance solution sub-tank side valve, and then operates the sucking pumps 43*a* corresponding to each head group. In this manner, the white ink inside the downstream side place 420 is sucked and removed from the downstream side place 420. Alternatively, the maintenance solution flows into the downstream side place 420 from the maintenance solution sub-tank 365 through the fifth to eight supply tubes 402 to 408.

Then, such a state where the maintenance solution is present (stays) in the downstream side place 420 is maintained until the next white ink printing process (more specifically, maintained until the printing job is undertaken, the white ink is ejected to the head unit 30, and the next printing job of the white ink printing process where the printing job is performed for printing is undertaken). Accordingly, the phenomenon where the ink stays at the downstream side place 420 cannot occur and thereby it is possible to prevent the problem due to the stagnation of ink at the downstream side place 420.

Furthermore, when the printing job is undertaken for the next white ink printing process, as a preparation process for the white ink printing process, the controller 60 performs a process (for convenience, the process is referred to as an ink returning process) which causes the ink to flow into the downstream side place 420. That is, the controller 60 performs a process opposite to when causing the maintenance solution to flow in. In other words, the controller 60 opens the head unit side valve, closes the maintenance solution sub-tank side valve and then operates the sucking pump 43*a* corresponding to each head group. In this manner, the maintenance solution inside the downstream side place 420 is sucked and removed from the downstream side place 420. Alternatively, the white ink flows from the ink sub-tank 364 to the downstream side place 420 through the first to fourth supply tubes 372 to 378.

In addition, with regard to the white ink, the problem due to the stagnation of ink occurs more easily compared to the other inks. Therefore, although it has been already described that the ink circulation process is performed with respect to white ink only, the maintenance solution injection process is also performed only for the white ink in the same manner.

Accordingly, the supply system which supplies the maintenance solution to the downstream side place 420 is provided only at the white ink feeding unit 36, and is not provided at the other kind (color) ink feeding units 35.

However, without being limited to the above description, it may be preferable that in order to perform the maintenance solution injection process, the supply system may be provided at the other kind (color) ink feeding units 35 as well.

Advantageous Aspect of Image Recorder 1 According to Present Embodiment

As described above, the image recorder 1 according to the present embodiment includes the ink sub-tank 364 which stores the ink, the head unit 30 which ejects the ink onto the roll sheet 2, a plurality of the supply tubes for supplying the ink from the ink sub-tank 364 to the head unit 30, a plurality of the bypass tubes hung between the supply tubes which are respectively different, the maintenance solution sub-tank 365 which stores the maintenance solution, and the controller 60 that circulates the ink inside the circulation flow channel which is configured only by the supply tubes and the bypass tubes among the ink sub-tank 364, the head unit 30, the supply tubes, the bypass tubes, and that causes the maintenance solution to flow into the section which is located further to the downstream side of the supply tube than the circulation flow channel, and into the head unit 30 from the maintenance solution sub-tank 365.

That is, the present embodiment jointly adopts both of the ink circulation process which circulates the ink inside the circulation flow channel in order to prevent the problem due to the stagnation of ink in the supply tube or the head unit 30, and the maintenance solution injection process which causes the maintenance solution to flow into the section of the supply tube positioned at the further downstream side than the circulation flow channel, and into the head unit 30 (downstream side place 420).

Then, accordingly, the competitive advantage described below occurs. That is, assuming a case where only the above-described ink circulation process is attempted (tried) with respect to all the supply tubes and head unit 30, in this case, it is impossible to avoid that the place where the ink is not circulated occurs in the section positioned at the further downstream side of the supply tube than the circulation flow channel. In addition, it is impossible to circulate the ink even in the head unit 30 by the above-described ink circulation process. In other words, although it is possible to prevent the previously described problem due to the stagnation of ink in the most of the supply tubes, the problem occurs in the downstream side place 420.

On the other hand, assuming a case where only the above-described maintenance solution injection process is attempted (tried) with respect to entire supply tubes and head unit 30, in this case, it undesirable in viewpoint of the cost since the amount of the ink and the maintenance solution consumed (discarded) in the process (and the ink returning process which is set with the process).

In contrast, the design concept of the image recorder 1 according to the present embodiment is one (efficient measure) where the ink circulation process is performed as much as possible for the places capable of the ink circulation process which prevents the previously described problem without discarding the ink or the like, and the maintenance solution injection process is performed for the minimum number of places incapable of the ink circulation process. Therefore, it is possible to reduce the consumption amount of the ink or the maintenance solution and to prevent the above-described problem due to the stagnation of ink in the entire supply tubes and head unit 30. That is, according to the present embodiment, it is possible to efficiently prevent the problem due to the stagnation of ink.

Performance Timing for Maintenance Solution Injection Process

In the above description, as an example, the maintenance solution injection process is performed when the white ink printing process is completed. However, the performance timing of the maintenance solution injection process is not limited thereto.

Herein, the other examples (three examples, referred to as a first to third modification examples) of the performance timing for the maintenance solution injection process will be described.

An example where the maintenance solution injection process is performed when the white ink printing process is completed is preferable in that the above-described problem can be reliably prevented since the staying time of the ink in the downstream side place 420 is set to be a minimum time (approximately zero).

However, in this example, there is a possibility that the following disadvantageous situations may occur. That is, in a case where the white ink printing process is completed and the next white ink printing process is set to be performed soon (at a short time interval), if the maintenance solution injection process is not performed, the next ink printing process can be performed using the ink (this ink does not cause the problem due to the stagnation of ink since the interval is short) which is subjected to be discarded in the maintenance solution injection process. That is, in such a case, it results in discarding of the ink which can be used without any problems (due to the stagnation of ink) in the next white ink printing process.

Then, in consideration of the occurrence of the disadvantageous situation, in a first modification example, the maintenance solution injection process is performed at the following time. That is, the controller 60 undertakes the printing job, causes the white ink to be ejected to the head unit 30 and thereby perform the white ink printing process where the printing job is performed for printing. Then, the maintenance solution is caused to flow in when a prescribed time (for example, four hours) has elapsed without the next white ink printing process being performed after the white ink printing process is completed.

In this manner, in the first modification example, in consideration of a problem of ink consumption (in view of the cost) due to the occurrence of the above-described disadvantageous situation in addition to the problem due to the stagnation of ink, the maintenance solution is caused to flow in when a prescribed time has elapsed after the white ink printing process is completed. Therefore, according to the first modification example, it is possible to reduce the consumption amount of the ink and to prevent the above-described problem due to the stagnation of ink. Thus, it is possible to more efficiently prevent the problem due to the stagnation of ink.

Furthermore, it becomes a trade-off between both problems for how many hours are set to be a prescribed time. However, more emphasis being placed on the problem due to the stagnation of ink, it is preferable to set the time in such a manner that the time, that does not cause the above-described problem even if the ink stays, is derived by the experiment or the like (the same applies to a "prescribed time" in a second modification example to be described later).

In addition, the second modification example is also in consideration of both problems. In the second modification example, in a case where the white ink printing process is completed and then the next white ink printing process is determined to not be performed for a prescribed time (for example, four hours), the maintenance solution is caused to flow in when the white ink printing process is completed.

For example, an user or the like determines whether the next white ink printing process is performed or not for a prescribed time (for example, four hours) after the white ink printing process is completed. Then, when it is determined to not be performed, the user or the like gives a command to the image recorder 1, the image recorder 1 (controller 60) receives the command and causes the maintenance solution to flow in when the white ink printing process is completed.

In this manner, the second modification example also considers the problem of the ink consumption (in view of the cost) due to the occurrence of the above-described disadvantageous situation in addition to the problem due to the stagnation of ink. That is, in a case of satisfying a condition where the problem of the ink consumption (in view of the cost) does not occur, the ink is caused to flow in when the white ink printing process capable of reliably preventing the problem due to the stagnation of ink is completed. Therefore, according to the second modification example, it is possible to reduce the consumption amount of the ink and to prevent the above-described problem due to the stagnation of ink. Thus, it is possible to more efficiently prevent the problem due to the stagnation of ink.

In addition, a third modification example is an example which also considers both problems similarly to the first and second modification examples. That is, as a printing process, the controller 60 undertakes the white ink printing process and the printing job, causes the ink other than the white ink to be ejected to the head unit 30, and performs a printing process (referred to as a non-white ink printing process) such as a color printing or a monochrome printing where the printing job is performed for printing. However, based on the printing job, the controller determines whether next printing process of the white ink printing process is the non-white ink printing process, and in a case where the determination result shows the non-white ink printing process, causes the maintenance solution to flow in when the white ink printing process is completed.

For example, when the controller 60 undertakes the printing job of the next printing process during the performance of the white ink printing process, it is possible to determine whether the next printing process is the white ink printing process or the non-white ink printing process. That is, the controller 60 causes the determination by analyzing the printing job. Then, if the next printing process is the non-white ink printing process, the controller causes the maintenance solution to flow in when the white ink printing process is completed.

In this manner, the third modification example also considers the problem of the ink consumption (in view of the cost) due to the occurrence of the above-described disadvantageous situation in addition to the problem due to the stagnation of ink. That is, in a case where the determination result show the non-white ink printing process, the white ink printing process is not performed until at least the next printing process (in other words, the non-white ink printing process) is completed (for example, one to two hours). Thus, it is confirmed that the problem of the ink consumption (in view of the cost) does not occur. Accordingly, even in the third modification example, in a case of satisfying a condition where the problem of the ink consumption (in view of the cost) does not occur, the ink is caused to flow in when the white ink printing process capable of reliably preventing the problem due to the stagnation of ink is completed. Therefore, according to the third modification example, it is possible to reduce the consumption amount of the ink and to prevent the above-described problem due to the stagnation of ink. Thus, it is possible to more efficiently prevent the problem due to the stagnation of ink.

Another Advantage of Causing Maintenance Solution to Flow into Downstream Side Place 420

As described above, in the present embodiment, when the white ink printing is not performed, the ink is removed from the downstream side place 420 and alternatively the maintenance solution is caused to flow and stay in the downstream side place 420. Then, it has been already described that this procedure prevents the problems (problem such as precipitation of the ink ingredient or occurrence of clogging) due to the stagnation of ink, but another effect (benefits) may be obtained as follows.

That is, if the white ink is always present in the head unit 30 without the maintenance solution injection process being performed, there is a possibility that the following disadvantageous situation may occur.

That is, there is a case where the clogging occurs in a nozzle corresponding to an ink (corresponding to a second ink, as an example, a black ink is exemplified. However, it may be a yellow ink, a magenta ink, a cyan ink or the like) other than the white ink (corresponding to a first ink), and an sucking process is performed in order to suck the black ink inside the head unit 30 to clean the head unit 30. However, in such a case, the white ink inside the head unit 30 is also sucked at the same time. In other words, as described previously, when the sucking process is performed, a single cap comes into close contact with the lower surface (nozzle surface) of the head unit 30, and all kinds (all colors) of ink are sucked at the same time. Accordingly, when the black ink is sucked, the white ink is also sucked and consequently the white ink is wasted and discarded.

In particular, since the black ink is used more frequently than the white ink, a situation may occur where such an sucking process (sucking process by a cleaning command from the user, or the like) is frequently performed. Then, if fallen into such a situation, the white ink is consumed in large quantities for a purpose which is different from the original purpose such as a restoration from a non-ejection state of the nozzle corresponding to the black ink.

On the other hand, in the present embodiment, in a state where the maintenance solution is present in the head unit 30 instead of the white ink, this sucking process is set to be performed. That is, the controller 60 comes to perform the sucking process which sucks the maintenance solution and the black ink from the head unit 30 at the same time. Therefore, the white ink can be saved and thereby benefits are created in view of the cost.

In addition, the case where the sucking process is performed in order to restore the nozzle is described above. However, a flushing process is performed for the restoration and it may be considered that the flushing process where the controller 60 discharges the maintenance solution and the black ink from the head unit 30 at the same time is performed. Then, even in this case, the white ink can be saved and thereby benefits are created in view of the cost.

ANOTHER EMBODIMENT

In the above-described embodiment, the printer is mainly described, but a disclosure of a liquid (that is, the ink or the maintenance solution) transfer method is also included. In addition, the above-described embodiment aims to facilitate the understanding of the present invention, and is not construed as limiting the present invention. The present invention can be modified and improved without departing from the spirit thereof, and it is needless to say the present invention includes the equivalent thereof. In particular, an embodiment described below is also included in the present invention.

In the above-described embodiment, as a medium, the roll sheet 2 is exemplified for description, but without being limited thereto. For example, a cut paper, a film and a cloth may be used.

In addition, in the above-described embodiment, as an ink storage unit, the ink sub-tank 364 is exemplified for description, but not limited thereto. For example, there may be a case where the ink sub-tank 364 is absent and the ink cartridge 362 is connected to the head unit 30 via the supply tube (in this case, the ink cartridge 362 corresponds to the ink storage unit).

Similarly, as a maintenance solution storage unit, the maintenance solution sub-tank 365 is exemplified for description, but not limited thereto. For example, there may be a case where the maintenance solution sub-tank 365 is absent and the maintenance solution cartridge 363 is connected to the head unit 30 via the supply tube (in this case, the maintenance solution cartridge 363 corresponds to the maintenance solution storage unit).

In addition, in the above-described embodiment, the head unit 30 includes a plurality (15) of heads 31, but not limited thereto. For example, the head unit 30 may be formed from one head 31.

In addition, in the above-described embodiment, as a supply flow channel for supplying the ink from the ink storage unit to the head unit, the supply tube is exemplified for description, but not limited thereto. For example, it is not hindered to include a member (as an example, a self-sealing valve or the like) other than the supply tube.

What is claimed is:

1. A printer comprising:

an ink storage unit that stores an ink;

a head unit that ejects the ink onto a medium;

a plurality of supply flow channels for supplying the ink from the ink storage unit to the head unit;

a plurality of bypass flow channels hung between the plurality of supply flow channels which are respectively different, wherein the plurality of bypass flow channels include at least a first and second bypass flow channels that connect different supply flow channels of the plurality of supply flow channels, the second bypass flow channel being downstream the first bypass flow channel in a direction of flow of the ink from the ink storage unit toward the head unit;

a plurality of flow controllers, one on each of the plurality of supply flow channels, on a downstream side of the second bypass flow channel and upstream from the head unit;

a maintenance solution storage unit that stores a maintenance solution; and a controller that causes the ink to circulate inside a circulation flow channel which is configured only by the plurality of supply flow channels and the plurality of bypass flow channels, and that causes the maintenance solution to flow from the maintenance solution storage unit through the plurality of flow controllers into a section which is located further to the downstream side of the plurality of supply flow channels than the circulation flow channel, and into the head unit.

2. The printer according to claim 1, wherein the ink is a first ink, wherein the head unit ejects multiple types of ink including the first ink onto the medium, and wherein the controller undertakes a printing job, performs a first ink printing process where the printing job is performed for printing, by causing the first ink among the multiple kinds of ink to be ejected to the head unit, and causes the maintenance solution to flow in when a prescribed time elapses, without the next first ink printing process being performed, after the first ink printing process is completed.

3. The printer according to claim 1, wherein the ink is a first ink, wherein the head unit ejects multiple kinds of ink including the first ink onto the medium, wherein the controller undertakes a printing job and performs a first ink printing process where the printing job is performed for printing, by causing the first ink among the multiple kinds of ink to be ejected to the head unit, and undertakes the printing job and performs a non-first ink printing process where the printing job is performed for printing, by causing an ink other than the first ink among the multiple kinds of ink to be ejected to the head unit, and wherein, based on the printing job, the controller determines whether a printing process next to the first ink printing process is the first ink printing process or the non-first ink printing process, and in a case where the determination result indicates the non-first ink printing process, causes the maintenance solution to flow in when the first ink printing process is completed.

4. The printer according to claim 1, wherein as the ink storage unit, a first ink storage unit that stores a first ink is provided, wherein the head unit ejects the first ink onto the medium, wherein as a plurality of the supply flow channels, a plurality of first ink supply flow channels is provided in order to supply the first ink from the first ink storage unit to the head unit, wherein as a plurality of the bypass flow channels, a plurality of first ink bypass flow channels hung between the first ink supply flow channels which are respectively different is provided, wherein the controller causes the first ink to circulate inside the circulation flow channel which is configured by only the first ink supply flow channel and the first ink bypass flow channel among the first ink storage unit, the head unit, the first ink supply flow channel and the first ink bypass flow channel, and causes the maintenance solution to flow into the section which is located further to the downstream side of the first ink supply flow channel than the circulation flow channel, and into the head unit from the maintenance solution storage unit, wherein a second ink storage unit that stores a second ink is provided, wherein the head unit ejects the second ink onto the medium, wherein a plurality of second ink supply flow channels are provided in order to supply the second ink from the second ink storage unit to the head unit, and wherein the controller performs a sucking process that sucks the maintenance solution and the second ink from the head unit at the same time, or performs a flushing process that discharges the maintenance solution and the second ink from the head unit at the same time.

5. A liquid transfer method, comprising:

causing an ink to circulate inside a circulation flow channel which is configured only by a plurality of supply flow channels and a plurality of bypass flow channels between an ink storage unit that stores the ink and a head unit that ejects the ink onto a medium, the plurality of the supply flow channels supply the ink from the ink storage unit to the head unit, each of the plurality of flow channels being connected with the ink storage through an upstream flow controller, the plurality of the bypass flow channels hung between the supply flow channels which are respectively different, wherein the plurality of bypass flow channels include at least a first and second bypass flow channels that connect different supply flow channels of the plurality of supply flow channels, the second bypass flow channel being downstream the first bypass flow channel in a direction of flow of the ink from the ink storage unit toward the head unit, and a plurality of flow controllers, one on each of the plurality of supply flow channels, on a downstream side of the second bypass flow channel and upstream from the head unit; and causing a maintenance solution to flow through the plurality of flow controllers into a further downstream side section of the supply flow channels than the circulation flow channel, and into the head unit.

6. A liquid transfer method, comprising:

causing a first ink to circulate inside a circulation flow channel which is configured only by a plurality of first ink supply flow channels and a plurality of first ink bypass flow channels between a first ink storage unit that stores the first ink and a head unit that ejects multiple kinds of ink including the first ink onto a medium, the plurality of the first ink supply flow channels supply the first ink from the first ink storage unit to the head unit, the plurality of the first ink bypass flow channels hung between the first ink supply flow channels which are respectively different, wherein the plurality of first ink bypass flow channels include at least a first and second ink bypass flow channels that connect different first ink supply flow channels of the plurality of first ink supply flow channels, the second bypass flow channel being downstream the first bypass flow in a direction of flow of the ink from the ink storage unit toward the head unit, and a plurality of flow controllers, one on each of the plurality of supply flow channels, on a downstream side of the second bypass flow channel and upstream from the head unit;

performing a first ink printing process where a printing job is performed for printing, by undertaking the printing job and causing the first ink among the multiple kinds of ink to be ejected to the head unit; and causing a maintenance solution to flow through the plurality of flow controllers into a section which is located further to the downstream side of the first ink supply flow channel than the circulation flow channel, and into the head unit, in a case where it is determined that the next first ink printing process will not be performed for a prescribed period of time after the first ink printing process is completed.

* * * * *